US005996929A

United States Patent [19]

Mazodier et al.

[11] Patent Number: 5,996,929

[45] Date of Patent: Dec. 7, 1999

[54] COILER SPINDLE FOR WINDING A BAND-TYPE PRODUCT AND ITS USE

[75] Inventors: François Mazodier, Saint Etienne; Claude Rollet, Montbrison, both of France

[73] Assignee: Kvaerner Metals Clecim, Paris, France

[21] Appl. No.: 09/055,324

[22] Filed: Apr. 6, 1998

[30] Foreign Application Priority Data

Apr. 10, 1997 [FR] France ..... 97 04424

[51] Int. Cl.[6] ..... B65H 75/24

[52] U.S. Cl. ..... 242/573.7; 242/909

[58] Field of Search ..... 242/571, 573, 242/573.7, 576.1, 909, 572, 573.2, 573.3, 573.5, 573.6, 573.9; 279/2.11, 2.12, 2.13, 2.14, 2.15

[56] References Cited

U.S. PATENT DOCUMENTS

| | | | |
|---|---|---|---|
| 2,989,263 | 6/1961 | Smeets | 242/576.1 X |
| 3,075,720 | 1/1963 | Theobald | 242/576.1 |
| 3,754,720 | 8/1973 | Gross et al. . | |
| 3,878,999 | 4/1975 | Daves | 242/576.1 X |
| 4,154,412 | 5/1979 | Briar et al. | 242/576.1 X |
| 4,175,712 | 11/1979 | Schippers et al. | 242/576.1 X |
| 4,630,785 | 12/1986 | Buchegger et al. | 242/573.7 |

FOREIGN PATENT DOCUMENTS

| | | | |
|---|---|---|---|
| 3106744 | 5/1991 | Japan | 242/576.1 |
| 1299640 | 3/1987 | U.S.S.R. | 242/573.7 |
| 954015 | 4/1964 | United Kingdom . | |

*Primary Examiner*—John M. Jillions
*Assistant Examiner*—William A. Rivera
*Attorney, Agent, or Firm*—Nikaido, Marmelstein, Murray & Oram LLP

[57] ABSTRACT

A coiler spindle for winding a band-type product such as the material coming from a continuous casting machine which includes a central shaft rotatable about an axis and having a set of adjacent segments surrounding the shaft. Each segment is mounted to slide radially on the shaft and comprises a curved plate having an external face in the shape of a cylindrical sector. The diameter of the spindle can be changed by radial displacement of the segments. Cooling of the segments is provided by the circulation of a heat exchanger fluid along each segment from a fluid box fixed to the central shaft and having at least two separate chambers. The chambers including a supply and an evacuation chamber. Each segment is provided with its own individual cooling down system arranged within the curved plate. Each individual cooling down system includes an inlet orifice connected to the supply chamber and an outlet orifice connected to the evacuation chamber. A ductile connector is used to connect each orifice to the respective chamber.

14 Claims, 3 Drawing Sheets

COILER SPINDLE FOR WINDING A BAND-TYPE PRODUCT AND ITS USE

FIELD OF THE INVENTION

This invention relates to a coiler spindle for winding a band-type product, more especially a metal band.

BACKGROUND OF THE INVENTION

Such spindles are used, in particular, in metal band rolling and treatment plants comprising, normally, various pieces of equipment, particularly for rolling, levelling, etching and other treatments. At the outlet of a section of the plant, the metal band must, generally, be wound into a coil to be then transported to another section or any other point of treatment.

To this end, a coiler is used which comprises a spindle consisting of a cylindrical bar brought into rotation around its axis and provided with means for fastening the end of the band which thus is wound into a coil around the cylindrical bar.

Generally, the winding bar is variable in diameter and may be retracted to enable retraction of the coil after winding.

To this end, the spindles used usually comprise a supporting shaft centered on an axis and associated with rotation driving means and a plurality of circular segments forming together a more or less cylindrical surface and attached to the central supporting shaft with the possibility of radial displacement in order to allow the variation of the diameter of the cylindrical surface thus constituted and on which the band is wound.

To control the diameter variation of the spindle, a rack-operated device is used conventionally, consisting of a control part, sliding axially on the central shaft, and on which at least one conical section is provided, working together with matching tilted faces, arranged in the segments, whereby the latter are maintained in a longitudinal direction with respect to the shaft and guided radially, in a transversal direction, in order to be able to come away from or to come closer to the central shaft by longitudinal displacement of the control part, under the action of an expansion rod mounted to slide in an axial bore of the central shaft.

The central shaft is generally mounted to rotate, via bearings spaced from one another, on a supporting chassis in which are located the rotation driving means. Displacement of the expansion rod can be controlled by a jack resting on the shaft, at the end opposite to the spindle.

For correct operation of the spindle; the different parts moving with respect to each other, must be able to do so with minimum friction. Careful lubrication at the level of the contact surfaces of the parts moving in relation to one another has been provided in this view.

Until now, such spindles had been used mainly in rolling plants. When the rolled band is hot, the internal parts of the spindle are heated up, which can disturb the operation of the spindle.

It has been, therefore, suggested to cool the spindle down by circulating a heat exchanger fluid, for example water, between the segments and the central shaft carrying the rack-operated control device. In such a case, however, it is necessary to ensure perfect tightness of the cooling system in order to avoid water ingress into the sections which must be lubricated.

The document GB-A-954015 describes, for instance, a spindle of this type in which each segment is provided, on its internal face, with ribs closed by the associated rack and in which the cooling fluid is forced to circulate. This fluid is introduced through the axial bore provided in the central shaft for the passage of the expansion rod and flows through orifices drilled radially in the shaft and each connected by a telescopic tube to a channel arranged on the rear section of each segment and to which the ribs of the former lead.

Such a layout does not enable to ensure perfect tightness and can only be used for moderate temperatures of the band and relatively short cycles, ranging between 3 and 5 minutes.

Besides, the fluid rejected under pressure at the front end of the spindle might be sprayed onto the band being wound, which is detrimental to the surface quality of the latter.

The purpose of the invention is to remedy these problems thanks to a new layout enabling to ensure very efficient cooling-down of the spindle and, consequently, winding around the said band whose temperature may be high.

Especially, for some time, researches have aimed at developing new technologies for continuous casting of bands of very little thickness and it is interesting, in such a case, to be able to wind into a coiler such a band around a spindle.

Yet, shortly after casting, the temperature of the band is still very high and, on the other hand, the winding time and, consequently, the time spent by the coiler on the spindle can be rather long, unless the coilers are kept very short, which would be of little interest.

Indeed, the winding time is related to the casting speed which is, obviously, much slower than a rolling speed.

It has therefore appeared that the spindles used until now, even if they are fitted with a cooling system, could not sustain such a heat transmission, because of the various thermal effects, particularly constraints and expansions of the various parts, liable to disturb the operation.

The invention enables to cancel these shortcomings thanks to provisions which, without complicating the construction of the spindle, ensure reliable operation of the said spindle, even in the case of low speed winding of very hot bands from, for instance, a continuous casting plant.

SUMMARY OF THE INVENTION

The invention thus relates, generally, to a coiler comprising at least one spindle limited by a substantially cylindrical surface for winding a band-type product, whose diameter may vary by expansion or retraction of the spindle, the spindle comprising a central shaft brought into rotation around an axis, a set of adjacent segments surrounding the shaft and mounted to slide radially on the shaft, whereby the segments are limited by a curved plate with an external face in the shape of a cylindrical sector, means to control the expansion or the retraction of the spindle by radial displacement of the segments and cooling-down means of the spindle by circulation of a heat exchanger fluid along each segment.

According to the invention, the cooling-down means comprise a fluid box fixed to the central shaft and comprising at least two separate chambers, respectively at least one supply chamber connected to a heat exchanger fluid supply system and at least one evacuation chamber connected to the fluid evacuation system and each segment is provided with an individual cooling-down system arranged inside the curved plate and having two orifices, respectively, inlet and outlet orifices for the heat exchanger fluid, each connected by a ductile connector, to one of the chambers of the fluid box, respectively an inlet orifice connected to a supply chamber and an outlet orifice connected to an evacuation chamber.

According to a preferred embodiment, each curved plate of a segment is extended ahead of the front end of the shaft, by a free end having an internal face on which have been arranged the inlet and outlet orifices of the cooling-down fluid, whereas the free ends of the segments limit a hollow space in which is placed the fluid box, and the supply and evacuation systems are connected respectively to at least two conduits going through the shaft longitudinally up to its front end and leading, respectively, to at least one supply chamber and at least one evacuation chamber of the fluid box, whereas the chambers are connected, respectively, to the inlet and outlet orifices of the plates by conduits of variable length.

According to another preferred feature, the central shaft comprises, on the side of the supporting chassis, a rear end on which a tight ring has been attached forming a rotary seal, provided with two grooves opened on the shaft side and with two orifices, respectively inlet and outlet orifices, leading to each of the grooves and connected respectively to both supply and evacuation systems and the supply and evacuation conduits go through the shaft over the whole length of the shaft from its front end down to its rear end and each leading, through an orifice to the corresponding groove, respectively the supply and evacuation grooves of the rotary seal.

Particularly advantageously, the individual cooling-down system arranged inside the curved plate covers the whole angular sector covered by the plate and is located as close as possible to its internal face.

Generally, such a spindle comprises, as already indicated, a central rotary shaft on which is mounted a rack-operated device for control of the radial expansion and of the retraction of the segments, whereby this device is controlled via an expansion rod going through the central shaft inside an axial bore and to which a resting plate is attached, connected to the rack-operated device.

Particularly advantageously, the resting plate attached to the expansion control rod is located in a free space arranged between the fluid box and the front end of the central shaft in order to be able to move axially under the action of the control rod for controlling the expansion or retraction of the segments.

According to an embodiment frequently used, the spindle comprises four adjacent segments of angular opening close to 90°. In such a case, the fluid box advantageously has a substantially square contour and comprises four right-angle caissons, respectively two supply caissons diametrically opposite to one another and two evacuation caissons, situated between the supply caissons.

Each caisson, respectively supply or evacuation caisson, is therefore provided with a pair of orifices to which are connected, via ductile tubes, the corresponding inlet or outlet orifices respectively, of two adjacent segments.

According to a particularly advantageous layout, the curved plate of each segment constitutes a stand-alone cooling-down device with flattened section, inside which a heat exchanger fluid circulation system is provided, between an inlet orifice and an outlet orifice placed at one end of the plate, whereby the latter is applied and fixed removable on an external cylindrical face of a segment body mounted on the central shaft.

According to another preferred feature, the curved plate of each segment constitutes a hollow chamber with flattened section, limited by two parallel curved walls in the shape of cylindrical sectors and spaced from one another, respectively an internal wall and an external wall constituting a section of the cylindrical winding surface, whereby the walls are connected leak-proof to each other over their circumference, and the chamber thus limited is divided by at least one partition into at least two sections communicating with one another via at least one passage in order to provide a heat exchanger fluid circulation system over the whole surface of the curved plate, between an inlet orifice and an outlet orifice arranged on the internal wall and leading, respectively, to both sections of the chamber.

The invention covers more specifically the use of a coiler spindle such as defined previously for winding hot metal bands coming out of a continuous thin-band-casting machine.

The invention also covers other advantageous provisions which will be described more in detail below.

DETAILED DESCRIPTION OF THE PREFERRED EMBODIMENT

Figure 1:
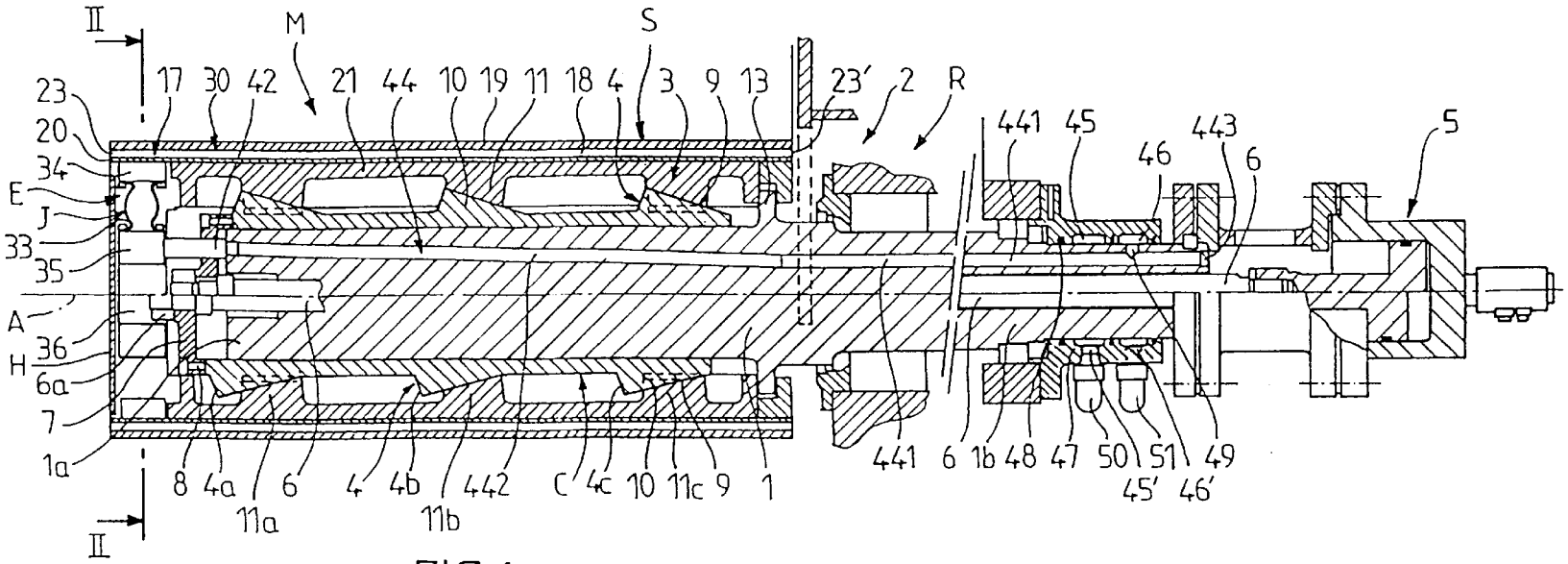
FIG. 1 is a longitudinal section, with some sections removed, of a coiler spindle according to the invention, in expanded position of the upper semi-section and in retracted position of the lower semi-section.

FIG. 1 shows diagrammatically the entire coiler spindle M comprising, conventionally, a rotary supporting central shaft 1 which extends cantilever from a supporting chassis 2 comprising rotary driving means R of the shaft 1 around its geometrical axis A.

Around the shaft 1 are mounted segments 3. In the indicated example, the segments 3 are four in number and have an angular opening of substantially 90°. The four segments are identical. Each segment comprises a body 3 carrying a curved plate 30 in the form of a cylindrical sector extending more or less over the whole working axial length of the spindle M. The segments 3 can expand radially, and are retractable, they are maintained in position according to the axial direction by a clamp 13 of the central shaft 1 engaging into a corresponding rib arranged on the rear section of the body of each segment 3.

Figure 5:
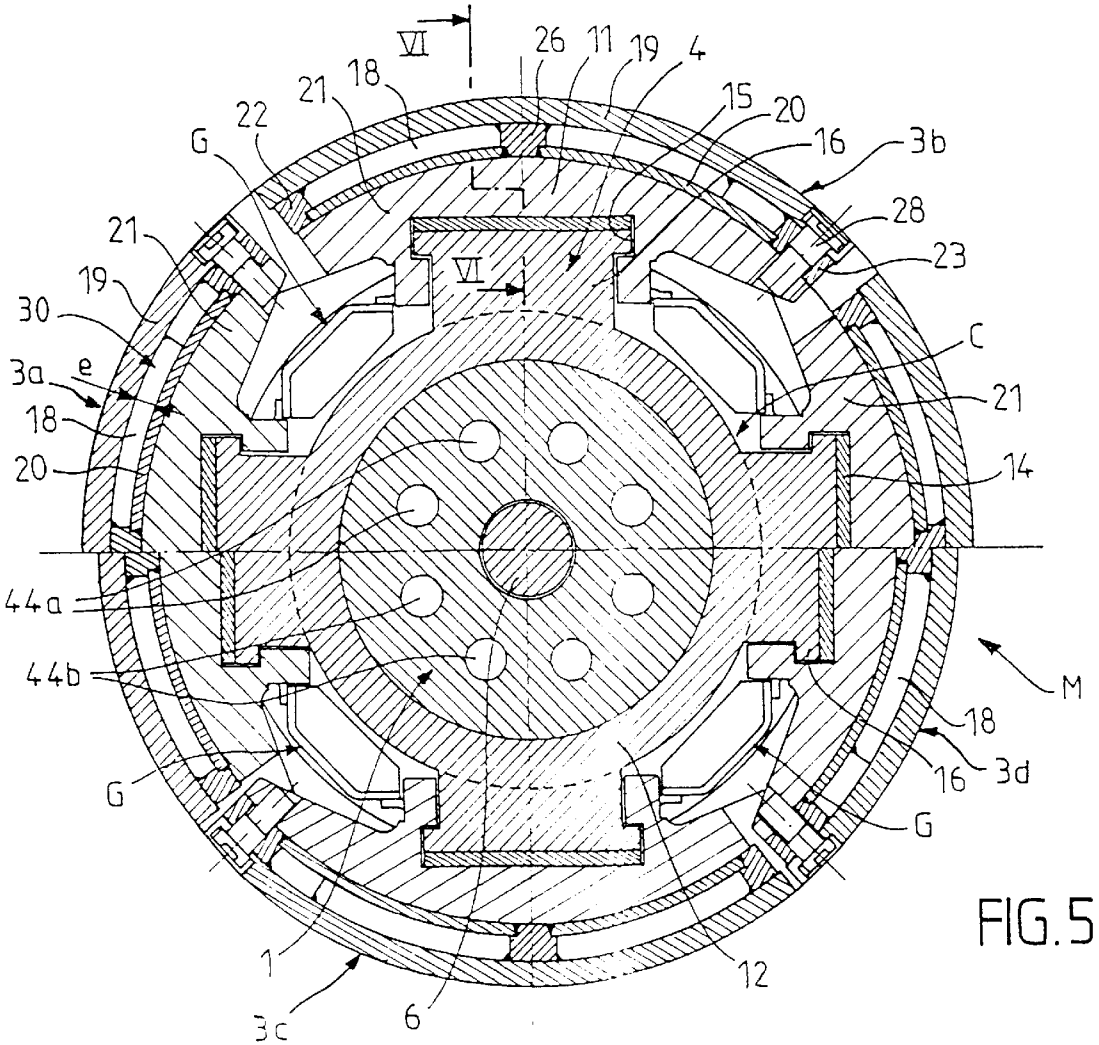
FIG. 5 is a section of the spindle along line V—V of FIG. 6, in expanded position for the upper semi-section and in retracted position for the lower semi-section.

On the central shaft 1 is attached, as shown on FIG. 5, a tubular sleeve C provided with protruding sections 4 forming racks associated respectively with each of the segments 3. In the indicated example, the sleeve C is thus provided with four racks 4 which each comprises, as shown on FIG. 1, three tilted faces 9 working together with three corresponding aligned pads 11 arranged on the body 3 of each of the segments and provided with matching tilted faces.

The expansion of the segments 3 is controlled by a jack 5, via an expansion rod 6 going through an axial bore of the shaft 1 over its whole length and connected to the piston of the jack 5 whose body rests on the chassis 2 or, directly on the rear end of the central shaft 1 opposite to the spindle.

At the end of the rod 6, protruding outside the front end of the shaft 1, on the side opposite to the chassis 2, is attached a control plate 7 whose average plane is orthogonal to the axis A and which is fixed at the end of the sleeve C by screws 8 regularly spaced. The plate is actuated by the jack 5, via the expansion rod 6, in order to determine the axial displacement of the sleeve C with the racks 4, along the shaft 1.

The racks 4, by moving from left to right as represented on FIG. 1, cause radial displacement towards the outside of the segments 3 thanks to the tilted surfaces 9 working together with the matching tilted faces of the pads 11 of the segments 3 which are blocked axially by the clamp 13.

In the embodiment represented, the shaft 1 is smooth externally and the racks 4, four in number, are arranged on the circumference of a tubular sheath 12 (FIG. 5), but other layouts using independent racks can be contemplated.

Figure 6:
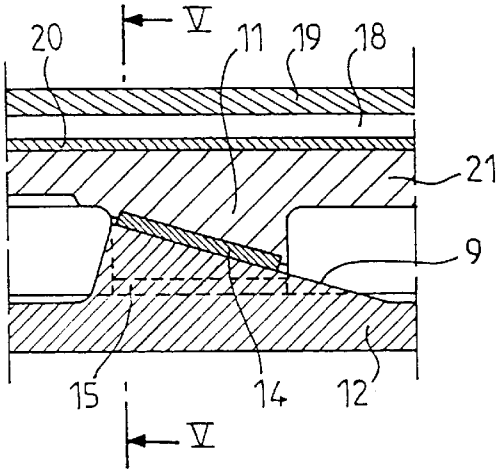
FIG. 6 is a partial section along line VI—VI of FIG. 5.

The tilted faces of the pads 11 of the segments 3 are provided with an antifriction coating 14 (see FIGS. 5 and 6) made of a plate fixed to the tilted face. A lubrication system, not illustrated, has been provided for lubrication of the surfaces of the racks and of the pads in contact.

The tilted faces 4*a*, 4*c* arranged respectively at both ends of each rack 4 each engage into a recess 15 arranged in the corresponding pad 11*a*, 11*c* of the segment 3 and whose bottom is tilted in order to provide the resting face of the pad. Moreover, the recess 15 has a T-shaped hollow transversal section comprising two lateral ribs 16 into which engage two ribs placed on the sides of the corresponding tilted face 4*a*, 4*c*, of the rack, with a simple assembly clearance. The segment 3 is thus maintained against the end faces 4*a*, 4*c* of the rack 4 with a possibility of axial sliding of the rack with radial displacement of the segment 3. Conversely, the central tilted face 4*b* of the rack rests simply on the corresponding pad 11*b* in order to allow for expansions.

The external faces 19 of the curved plates 30 are connected tangentially in order to form, for winding the product, a substantially cylindrical surface which is by continuous in the retracted position of the spindle. Both positions, respectively expanded and retracted have been represented as semi-sections on FIG. 5 whose upper section represents the expanded position, whereas the lower section is in retracted position.

Figure 4:
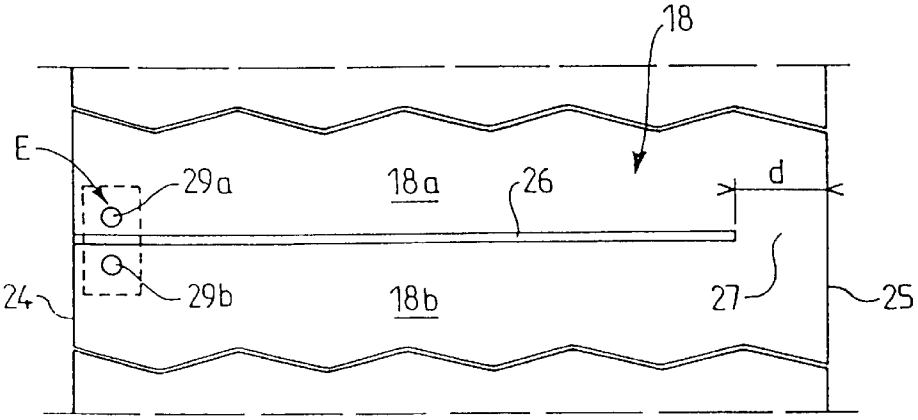
FIG. 4 is a diagrammatic plan view, with sections removed, of the inside of a fluid circulation chamber in a segment.
Figure 3:
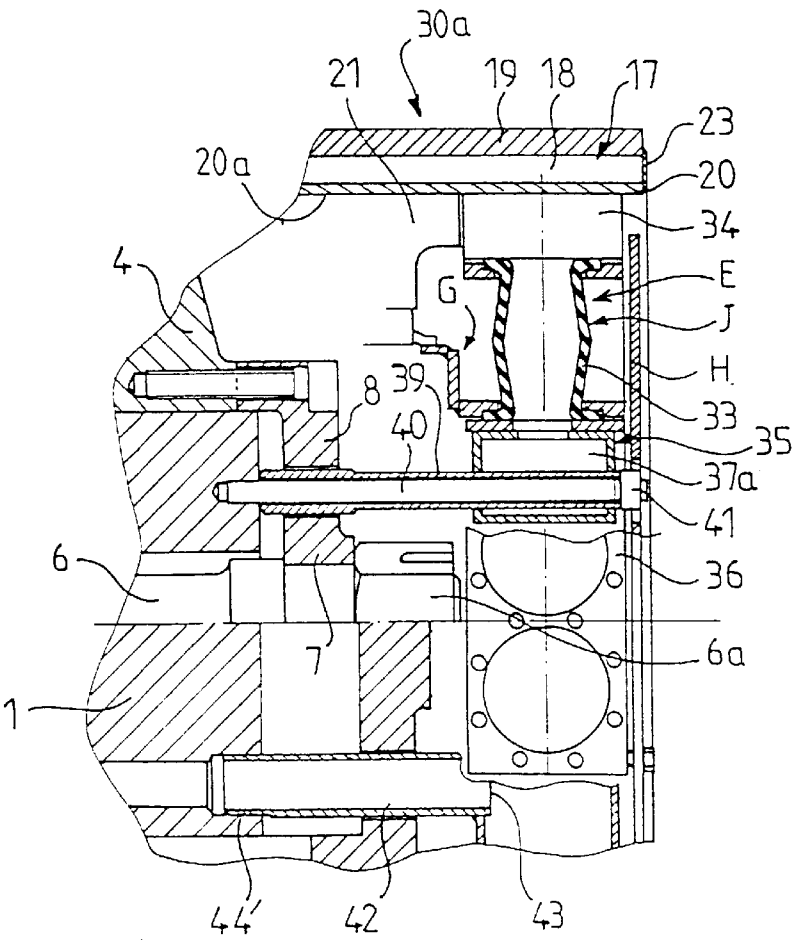
FIG. 3 is a partial section with external sections along line III—III of FIG. 2.

As shown on FIG. 4, the lateral edges of the curved plates 30 can advantageously be limited by broken or undulating lines forming, on the opposite edges, hollow or protruding sections, nesting into one another.

Each curved plate 30 comprises channels for circulation of a heat exchanger fluid forming a closed circuit between an inlet orifice 29*a* and an outlet orifice 29*b*. Both orifices, respectively inlet 29*a* and outlet 29*b* of this circuit are placed at the same end of the plate 30 and are connected by ductile tubes to corresponding orifices of two chambers, respectively supply and evacuation chambers, arranged in a fluid box 35 fixed to the central shaft 1, between the segments.

Particularly advantageously, the curved plate 30 of each segment 3 is extended, ahead of the front end 1*a* of the shaft 1, by a free end 30*a* with an internal face 20*a* on which have been provided the inlet 29*a* and outlet 29*b* orifices for the cooling-down fluid. Between the free ends 30*a* of the curved plates 30 is thus limited, ahead of the front end 1*a* of the shaft 1, a hollow space in which can be placed the fluid box 35, whereas the said box comprises at least one supply chamber 37*a* and at least one evacuation chamber 37*b* which are connected, respectively to supply 50 and evacuation 51 means of the fluid, through conduits 44, arranged longitudinally inside the shaft 1.

Advantageously, the cooling-down system arranged inside the curved plate 30 comprises the number of branches necessary to cover the whole surface of the cylindrical sector occupied by the curved plate 30. Moreover, the fluid circulation channels are placed as close as possible to the external face 19 of the plate 30, without reducing the resistance of the plate.

Thus, the heat transmitted by the band wound on the spindle is evacuated into the curved plate, very close to the contact zone of the coiler with the spindle, and the spindle members situated radially inside the segments are well protected from thermal effects without risks of water leaks detrimental to lubrication, whereas tightness can be ensured, even under high pressures, by simple ductile tubes.

In the preferred embodiment represented on the figures, the body 3 of each segment flares up towards the outside while forming a sole 21 limited by a convex face 21*a* on which is fixed a double wall assembly K having the shape of a curved plate and forming a stand-alone cooling-down device K comprising an internal chamber 18 with flattened section, limited by two parallel walls, respectively an external wall 19 and an internal wall 20, having the shape of cylindrical sectors covering approximately 90° and spaced from each other by a small distance. The chamber 18 thus delineated is closed tight, on both its sides by spacers 22, 22' and at its longitudinal ends by annular plates 23, 23' which connect the corresponding ends of both walls 19, 20.

Each double wall assembly K is applied onto the annular face 21*a* of the sole 21 of the segment body 3 and fixed to the sole by screws 28 engaged into tapered holes of the sole 21. The heads are accommodated in recesses of the external surface of the wall 19 in order not to protrude on the surface.

As indicated, the length of each double-wall cooling-down device K is slightly greater than that of the segment body 3 on which it is applied, in order to provide, ahead of the front end 1*a* of the shaft 1, a free space in which is placed the fluid box 35 for the circulation of a heat exchanger fluid such as water inside each chamber 18.

To ensure water circulation over the whole surface of the segment, the chamber 18 is divided, in the longitudinal direction, into two sections 18*a*, 18*b*, by a longitudinal partition 26 (FIG. 4) extending along the direction of the generating lines of the walls, parallel to the axis A. The partition 26 is connected in a leak-proof manner, for example by a welding process, to the end wall 24 and stops at a distance (d) from the other end wall 25 to form a passage 27 creating a communication between both sections 18*a*, 18*b*. The partition 26 is welded leak-proof to the walls 19 and 20.

The fluid box 35 has an annular form with, preferably, a polygonal section whose number of sides corresponds to that of the segments. In the example represented, the fluid box 35 has therefore a square section and comprises four sides respectively perpendicular to the axes of the segments 3.

The fluid box 35 forms thus a prismatic ring, square in the example considered, comprising an axial opening 36 centered on the axis A of the shaft 1. The annular box 35 is divided into caissons 37*a*, 37*b* by partitions 38 orthogonal with respect to the walls of the chamber. Every caisson thus formed has the shape of a straight dihedron and is provided with an orifice on each face of the dihedron, so that each caisson comprises two orifices, respectively supply 31*a* in the case of the caissons 37*a* or evacuation 31*b* in the case of the caissons 37*b*. Four caissons are thus distributed along the contour of the box 35, whereas a supply caisson 37*a* is located between two evacuation caissons 37*b*, each caisson being situated at an angle to the box 35.

Figure 2:
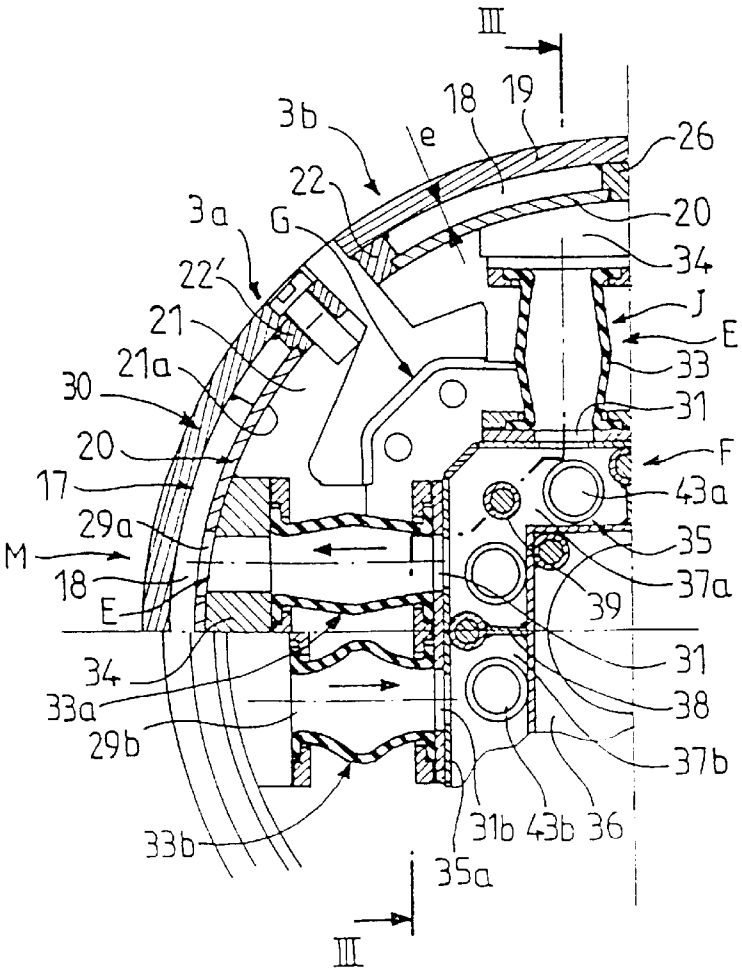
FIG. 2 is a partial section, at a larger scale, along line II—II of FIG. 1.

As shown on FIG. 2, the direction of circulation in the adjacent segments are alternate so that a dihedron caisson 37*a* feeds the chambers 18 of two neighbouring segments 3*a*, 3*b*, through the orifices 29*a*, while the neighbouring evacuation caisson 37*b* is associated to the evacuation orifices 29*b* of the segment 3*a* and of the other adjacent segment 3*c*, diametrically opposite the segment 3*b*.

The fluid box 35 is fixed at the end of the shaft 1 of the spindle by studs 40 each going through a tubular sheath 39 welded on the water box 35 and passing, in a leak-proof manner, through the annular chamber 37. Each stud is threaded at its ends, whereby the rear end is screwed in a tapered hole arranged on the supporting shaft 1 and the front end accommodates a nut 41 clamped on the corresponding tube 39 in order to fasten the fluid box 35 on the end of the shaft 1 while creating a free space for the displacement of the plate 7 with the rod 6 controlling the movement of the racks 4. To allow for this displacement, the tubes 39 pass freely through holes arranged in the plate 7.

The whole supply system is covered by a protection plate H fastened on the front face of the fluid box 35.

On the rear face directed towards the axis A, of the fluid box 35, are welded needles 42 leading inside the caissons 37*a*, 37*b* by orifices 43*a*, 43*b* (FIG. 2). Two needles 42 are provided for each caisson, whereas an orifice 43 is situated on each side of the angle of the caisson. Both needle of a given caisson ensure, according to the case, the supply or evacuation of water.

Each needle 42 (FIG. 1) goes through a corresponding passage provided in the plate 7 and engages, at its end directed towards the shaft 1, into an orifice 44' provided with a gasket and constituting the outlet of a conduit 44 going through the shaft 1 longitudinally. The latter is therefore provided, in the example represented, with eight conduits 44 respectively four supply conduits 44*a* and four evacuation conduits 44*b*. Each conduit 44 comprises, at the level of the chassis 2, a section 441 parallel to the axis of rotation A of the shaft 1 and, at the level of the spindle, a section 442 which is slightly tilted with respect to the axis A so that the orifices 44' distributed over the circumference of the shaft 1, are located at a sufficient distance form the axis A to allow for the passage of a hub 6*a* fastening the expansion rod 6 to the plate 7.

At their rear ends opposite to the spindle, the conduits 44 are closed by plugs 443 and are each provided with a lateral orifice 49 going through, radially, the corresponding section of the shaft 1 on which is attached a rotary seal 47 made of a ring in which are provided two annular grooves 45, 46 offset longitudinally of the shaft. The orifices 49 leading respectively to the supply conduits 44 or the evacuation conduits 44*b* are offset longitudinally over the same distance, in order to mate with the groove 45 used for supply, or with the groove 46 used for evacuation. The body of the rotary seal 47 is fixed to the chassis 2 and is provided with annular gaskets 48 placed on either side of the grooves 45, 46 to enable the rotation of the shaft 1 while maintaining the tightness of each groove 45, 46. Each groove, respectively supply 45 and evacuation 46 groove, is connected to the outside via an orifice 45', 46' arranged radially in the body of the seal 47 and on which is tapped a conduit, respectively a supply 50 or evacuation 51 conduit.

As indicated, in the example presented, the fluid box 35 comprises two supply chambers 37*a*, diagonally opposite to each other, which are connected by needles 42, the conduits 44 and the groove 45 to the duct 50 supplied with water and two evacuation chambers 37*b* connected similarly, by the groove 46, to the water evacuation duct 51.

The water circulation means comprise, for each chamber 18, a supply orifice 29*a* and an evacuation orifice 29*b*, provided in the wall 20, in the vicinity of the end wall 24, on either side of the partition 26 (FIG. 4)). These orifices are provided in the zone of the wall 20 extending, along the axial direction, beyond the sole 21 of the side opposite to the chassis 2 (FIG. 1).

Both orifices 29*a* and 29*b*, provided on each segment 3, move radially with the segment during the radial expansion or retraction movements and are therefore connected via radially extensible connection means J (FIG. 2), to the orifices 29*a* and 29*b* and the orifices, respectively supply 31*a* and evacuation 31*b* orifices, provided on the water box 35 and are therefore fixed radially.

In the example represented, each cooling-down plate 30 is provided with a junction piece 34 fixed to the internal wall 20 at the front end of the wall protruding beyond the shaft 1, i.e. at the level of the fluid box 35. The junction piece 34 is provided with two orifices 29*a*, 29*b*, leading to both chambers 18*a*, 18*b* of the cooling-down plate 30, on either side of the central partition 26 and are connected, respectively, to both orifices 31*a*, 31*b* which are provided on the corresponding face 35*a* of the fluid box 35 on either side of the partition 38. The connection is made by a tube 33 of a ductile material, for example an elastomer; which can advantageously have the shape of a biconical barrel represented on FIG. 2, in order to be squeezed easily, whereby both ends of each tube 33 are applied in a leak-proof manner by flanges, respectively onto the fluid box 35 and onto the junction piece 34.

Thus the chamber 18*a* of each cooling-down plate 30 is connected to the corresponding chamber 37*a* of the fluid box 35, itself water-supplied, from the supply duct 50, by a conduit 44*a* going through the shaft 1.

The water which penetrates through the orifice 29*a* circulates in the chamber 18*a* up to the end of the segment, turns around the central partition 26 and comes back via the chamber 18*b* to escape through the orifice 29*b* connected to the evacuation chamber 37*b* of the fluid box 35, which is itself connected by a conduit 44*b*, to the groove 46 leading to the evacuation duct 51.

Thus, continuous circulation of water is provided in a closed circuit, without disturbing the rotation of the spindle, nor expansion nor retraction of the spindle, whereas the control plate 7 can move freely between the end of the spindle and the fluid box 35 to control the radial displacement of the segments 3, whereas the corresponding cooling-down plates 30 are connected in a leak-proof manner to the supply and evacuation conduits by the ductile tubes 33.

It therefore appears that the cooling-down system according to the invention does not make the construction of the spindle significantly more complicated since the whole water circulation system is located inside the spindle, whereby the fluid box 35 is accommodated in a small thickness space arranged at the front end of the shaft 1.

Besides, the risks of leak are low, even for rather high pressures, since the whole water circulation is performed by rigid conduits or directly provided inside various parts of the spindle, except for the ductile tubes 33 whose tightness can be ensured easily by pressure-resistant connections and which can, moreover, be monitored and replaced, if needed, quite readily.

To avoid any risk of pollution of the spindle, the front end of the spindle in which is accommodated the fluid box 35, can advantageously be closed by a protection plate H fixed by screws on the front end of the water box 35. On the rear side of the said fluid box is fixed an annular cover G of polygonal section comprising four branches extending between the pads 11 and are provided with ductile lip seals resting on the ends of the segments 3 and on the lateral faces of the pads 11 in order to prevent the ingress of water or of impurities into the control mechanism.

Obviously, the invention does not limit itself to the details of the embodiment which has just been described, whereas other layouts can be adopted without departing from the scope defined by the claims.

In particular, the invention relates to any type of spindle comprising adjacent segments liable to come away from or to come closer to one another, whereby the number of segments can differ without significant modification of the layouts which have just been described and whereas the fluid box has a polygonal section corresponding to the number of segments. The water circulation system which has been described implies an even number of segments, but this could be modified, particularly to reduce the number of bores arranged in the shaft 1.

Also, it is advantageous to cool down the spindle by circulating water, but other heat exchanger fluids could be used as well, obviously.

What is claimed is:

1. A coiler spindle comprising at least one spindle limited by a substantially cylindrical surface for winding a band-type product, centered on an axis and having a variable diameter, the spindle comprising a central shaft brought into rotation around the axis, a set of adjacent segments surrounding the shaft and brought into rotation together with the shaft, each segment being mounted to slide radially on the central shaft and comprising a curved plate having an external face in the shape of a cylindrical sector, means to control the expansion or the retraction of the diameter of the spindle by radial displacement of the segments and means for cooling the spindle by circulation of a heat exchanger fluid along each segment, wherein the cooling means comprise a fluid box fixed to the central shaft and having at least two separate chambers, said chambers including at least one supply chamber connected to a heat exchanger fluid supply system and at least one evacuation chamber connected to a fluid evacuation system; each segment having an individual cooling-down system arranged within the curved plate and having two orifices which include an inlet orifice and an outlet orifice for the heat exchanger fluid, each orifice being connected by a ductile connector to one of the chambers of the fluid box, the inlet orifice being connected to the at least one supply chamber and the outlet orifice being connected to the at least one evacuation chamber.

2. A coiler spindle according to claim 1, further comprising a supporting chassis, the central shaft being mounted on the supporting chassis and extending, on the opposite side, up to a front end, wherein each curved plate is extended ahead of the front end of the shaft, by a free end having an internal face on which are arranged the inlet and outlet orifices of the cooling-down fluid, the free ends of the segments limit, before the front end of the shaft, a hollow space in which is placed the fluid box whereby the supply and evacuation systems are connected respectively to at least two conduits going through the shaft longitudinally up to the front end of the shaft and leading, respectively, to the at least one supply chamber and the at least one evacuation chamber of the fluid box, and wherein said ductile connectors connect the chambers, respectively, to the inlet and outlet orifices of the plates and are made of an blastomeric material.

3. A coiler spindle according to claim 2, wherein the central shaft comprises, on the side of the supporting chassis, a rear end having a rotary seal comprising a ring attached to said rear end, said ring being provided with two grooves opened on the shaft side and with two orifices, respectively inlet and outlet orifices, leading to each of the grooves and connected respectively to both supply and evacuation systems and the supply and evacuation conduits go through the shaft over the whole length of the shaft from the front end down to the rear end and each leading, through an orifice to the corresponding groove, respectively the supply and evacuation groove of the rotary seal.

4. A coiler spindle according to claim 2, wherein the means to control the expansion and the retraction of the diameter of the spindle comprises a rack-operated device carried on the central shaft alternately movable along the central shaft, for control of the radial expansion and of the retraction of the segments, a control rod going through the central shaft inside an axial bore and having a front end, a resting plate attached to the front end of the control rod and, connected to the rack-operated device, the resting plate being located in a free space arranged between the fluid box and the front end of the central shaft in order to be able to move axially under the action of the control rod for controlling the expansion or retraction of the segments.

5. A coiler spindle according to claim 4, wherein the fluid box is fixed to the end of the central shaft by studs, each stud going through a tubular sheath fixed to the fluid box and passing, in a leak-proof manner, through the box and extended on the side of the central shaft by a free section resting on the front end of the central shaft in order to maintain a space between the front end of the shaft and the fluid box for axial displacement of the resting plate, the resting plate being provided with holes for the passage of the sheaths enabling the plate to slide freely.

6. A coiler spindle according to claim 4, further comprising a needle connecting each chamber, respectively supply and evacuation chamber of the fluid box in a leak-proof manner, respectively, to the corresponding channels arranged in the central shaft, the needle extending in the space between the fluid box and the end of the shaft and passing through a corresponding passage in the resting plate with a predetermined clearance there around to enable the resting plate to slide freely.

7. A coiler spindle according to claim 4, wherein the rack operated device comprises a tubular sheath mounted to slide axially on the central shaft and provided externally with a plurality of protruding sections with tilted faces, each section constituting at least one rack on each of the segments, each segment having a body radially provided with at least one pad with a tilted face working together with a matching tilted face of the corresponding at least one rack.

8. A coiler spindle according to claim 7, wherein each pad of each segment body is provided with a recess open on the shaft side and having a T-section comprising a tilted bottom constituting the tilted face of the pad and two lateral grooves into which engage two ribs placed on the sides of the tilted face of the rack.

9. A coiler spindle according to claim 1, wherein said set of segments comprises four segments of angular opening close to 90° and wherein the fluid box has a substantially square contour and comprises four right-angle caissons, said four caissons including two supply caissons diametrically opposite to one another and two evacuation caissons situated between the supply caissons.

10. A coiler spindle according to claim 9, wherein each caisson, respectively supply or evacuation caisson, is provided with a pair of orifices, respectively supply or evacuation orifices, to which are connected, via the ductile connectors, the corresponding inlet or outlet orifices respectively, of two adjacent segments.

11. A coiler spindle according to claim 1, wherein each individual cooling-down system arranged within the curved plate covers the whole angular sector covered by the plate and is located adjacent to the external face of the plate.

12. A coiler spindle according to claim 1, wherein the individual cooling-down system of the curved plate of each segment constitutes a hollow chamber with flattened section, limited by two parallel curved walls in the shape of cylindrical sectors and spaced from one another, respectively an internal wall and an external wall constituting a section of the substantially cylindrical winding surface, the walls being connected in a leak-proof manner to each other over their circumference, and the hollow chamber is divided by at least one partition into at least two sections communicating with one another via at least one passage in order to provide a heat exchanger fluid circulation system over the whole surface of the curved plate, between the inlet orifice and the outlet orifice arranged on the internal wall and leading, respectively, to both sections of the chamber.

13. A coiler spindle according to claim 1, wherein the individual cooling-down system of the curved plate of each segment constitutes a stand-alone cooling-down device with flattened section, inside which a heat exchanger fluid circulation system is provided, between the inlet orifice and the outlet orifice, and the plate is applied and fixed removable on an external cylindrical face of a segment body.

14. A coiler spindle according to claim 1 for winding hot metal bands at the outlet of a continuous casting machine.

* * * * *